US007895955B2

(12) United States Patent
Ferder et al.

(10) Patent No.: US 7,895,955 B2
(45) Date of Patent: Mar. 1, 2011

(54) SHELF SYSTEM

(75) Inventors: Paul J. Ferder, Hudson, OH (US); Vall A. Iliev, Stow, OH (US)

(73) Assignee: FT Products, LLC, Kent, OH (US)

( * ) Notice: Subject to any disclaimer, the term of this patent is extended or adjusted under 35 U.S.C. 154(b) by 722 days.

(21) Appl. No.: 11/686,459

(22) Filed: Mar. 15, 2007

(65) Prior Publication Data

US 2007/0262036 A1 Nov. 15, 2007

Related U.S. Application Data

(60) Provisional application No. 60/782,553, filed on Mar. 15, 2006.

(51) Int. Cl.
*A47B 5/00* (2006.01)
*A47B 5/02* (2006.01)
*A47F 5/08* (2006.01)

(52) U.S. Cl. ..... 108/149; 108/182; 108/185; 211/90.04; 211/113; 211/134

(58) Field of Classification Search ..... 211/86.01, 211/87.01, 88.01, 90.01, 90.04, 94.01, 106, 211/113, 117, 118, 119, 135, 153; 312/245, 312/246, 247, 248; 108/42, 64, 65, 149, 108/182, 185; 248/224.51, 235, 317; 52/39, 52/506.01, 506.06, 592.1; 220/480, 481; 104/93

See application file for complete search history.

(56) References Cited

U.S. PATENT DOCUMENTS

| | | | | |
|---|---|---|---|---|
| 276,241 | A * | 4/1883 | Hanavan | 248/340 |
| 278,506 | A * | 5/1883 | Cassell | 248/317 |
| 322,873 | A * | 7/1885 | Wight | 52/362 |
| 384,947 | A * | 6/1888 | Wight | 52/506.06 |
| 531,257 | A * | 12/1894 | Bond | 108/103 |
| 728,018 | A * | 5/1903 | Roudil | 206/201 |
| 932,236 | A * | 8/1909 | Appleton | 211/119.006 |

(Continued)

FOREIGN PATENT DOCUMENTS

JP 8105154 4/1996

(Continued)

OTHER PUBLICATIONS

RE Williams Contractor Incorporated Rafter Solutions Storage Systems—Garage & Attic Storage, Author: REWilliams Contractor, Inc. Date: 2005. Innovative Material Handling Onrax Overhead Storage Racks, Author: Innovative Material Handling Date: 2005.

*Primary Examiner* — Darnell M Jayne
*Assistant Examiner* — Joshua Rodden
(74) *Attorney, Agent, or Firm* — Buckingham, Doolittle & Burroughs, LLP

(57) ABSTRACT

An overhead storage shelf having a pair of side panels, with each side panel including a base, an outer rib connected to the base, and at least one reinforcement rib connected to the base. The storage shelf further includes a mounting strip for connecting the pair of side panels, wherein the mounting strip facilitates the securing the shelf to a single beam. The storage shelf also includes a front plate and a rear plate. One of the front or rear plate includes a protruding member and the other of the front or rear plate contains a groove wherein the protruding member of one storage shelf can be engaged in the groove of another storage shelf, allowing multiple storage shelves to interconnect.

16 Claims, 7 Drawing Sheets

U.S. PATENT DOCUMENTS 1,143,443 A * 6/1915 Schramm ..... 312/246
1,243,788 A * 10/1917 Wooden ..... 108/182
1,312,891 A * 8/1919 Carlin ..... 108/182
1,329,541 A * 2/1920 Mermelstein ..... 211/119.17
1,331,621 A * 2/1920 Carlin ..... 108/182
1,343,818 A * 6/1920 Grammich ..... 211/153
1,566,551 A 12/1925 Ghrand
1,598,727 A * 9/1926 Jones ..... 248/159
1,645,179 A * 10/1927 Bunyan ..... 211/118
1,685,728 A 9/1928 Stone
1,758,934 A * 5/1930 Conrath ..... 248/304
1,794,700 A * 3/1931 McCaskey ..... 248/224.51
1,819,516 A * 8/1931 Kelly ..... 296/37.7
1,887,159 A * 11/1932 Knight ..... 248/489
1,973,866 A * 9/1934 Christianson et al. ..... 297/140
2,006,442 A * 7/1935 Connors ..... 312/301
2,011,356 A * 8/1935 Ford ..... 108/42
2,057,092 A * 10/1936 Lewis ..... 182/113
2,140,611 A * 12/1938 Smith et al. ..... 108/26
2,316,053 A * 4/1943 Davis ..... 248/215
2,389,171 A * 11/1945 Urbain ..... 52/283
2,435,288 A * 2/1948 Nisenson ..... 160/177 R
2,458,332 A * 1/1949 Boschan ..... 248/249
2,569,832 A * 10/1951 Shoener ..... 211/119
2,580,980 A * 1/1952 Vrooman ..... 108/42
2,587,150 A * 2/1952 Hansen et al. ..... 248/58
2,628,723 A * 2/1953 Booth et al. ..... 211/119.17
2,729,529 A * 1/1956 Nordmark et al. ..... 312/108
2,830,707 A * 4/1958 Schmidt et al. ..... 211/113
2,885,694 A * 5/1959 Ulm ..... 5/308
2,988,012 A * 6/1961 Markley et al. ..... 104/93
3,017,037 A * 1/1962 McDonnell ..... 211/113
3,041,035 A * 6/1962 Pascucci ..... 248/342
3,066,757 A * 12/1962 Robinson et al. ..... 182/36
3,187,517 A * 6/1965 Carbary ..... 62/344
3,295,284 A * 1/1967 Tschiesche ..... 52/506.07
3,331,645 A * 7/1967 Vercellotti ..... 312/248
3,352,071 A * 11/1967 Sutter ..... 52/28
3,371,976 A * 3/1968 Ritz, Jr. ..... 312/245
3,372,812 A * 3/1968 Parcels ..... 211/59.4
3,411,735 A * 11/1968 Hurd ..... 242/129.62
3,452,957 A 7/1969 Zuelsdorf
3,486,725 A * 12/1969 Laszlo ..... 248/68.1
3,524,520 A * 8/1970 Tidwell ..... 182/36
3,541,966 A * 11/1970 Greaves ..... 312/199
3,590,135 A * 6/1971 Herbenar et al. ..... 174/491
3,592,146 A * 7/1971 Loomans ..... 108/149
3,612,459 A * 10/1971 Walls ..... 248/215
3,615,153 A * 10/1971 Cagle ..... 211/113
3,645,051 A * 2/1972 Kolesar ..... 52/28
3,649,741 A * 3/1972 Fremont ..... 174/491
3,721,484 A * 3/1973 Macioge et al. ..... 312/245
3,735,951 A * 5/1973 Reed ..... 248/340
3,736,706 A * 6/1973 Stephenson ..... 52/28
3,750,563 A * 8/1973 Tonjum ..... 100/194
3,809,358 A * 5/1974 Hazeley ..... 248/317
3,828,507 A * 8/1974 Storer ..... 52/506.09
3,863,879 A * 2/1975 Herb ..... 248/327
3,895,605 A * 7/1975 Goldman ..... 119/245
3,898,782 A * 8/1975 Donato ..... 52/506.08
3,908,831 A * 9/1975 Brendgord ..... 211/88.01
3,931,452 A * 1/1976 Nilsson ..... 174/491
3,945,462 A * 3/1976 Griswold ..... 182/150
3,994,462 A 11/1976 Shine
4,061,092 A * 12/1977 Jacobsen et al. ..... 108/149
4,086,978 A * 5/1978 Clements ..... 182/82
4,231,625 A * 11/1980 Perez et al. ..... 312/245
4,257,206 A * 3/1981 Mieyal ..... 52/506.07
4,272,937 A * 6/1981 Brugman ..... 52/506.07
4,276,959 A * 7/1981 Barber ..... 182/150
4,319,421 A * 3/1982 Diamond ..... 40/617
4,325,486 A * 4/1982 Neal ..... 211/85.29
4,372,510 A * 2/1983 Skypala ..... 248/58
4,441,583 A * 4/1984 Vaught ..... 182/150
4,446,660 A 5/1984 Miller et al.
4,544,119 A * 10/1985 Kellett et al. ..... 248/58
4,570,749 A * 2/1986 McKibbin ..... 182/36
4,646,506 A * 3/1987 Slapsys ..... 52/772
4,653,818 A * 3/1987 DeBruyn ..... 312/246
4,694,531 A * 9/1987 Foy ..... 16/87.4 R
4,698,895 A * 10/1987 Miller et al. ..... 29/464
4,699,437 A 10/1987 Genereaux
4,700,849 A * 10/1987 Wagner ..... 211/41.2
4,735,470 A * 4/1988 Falk ..... 312/246
4,781,608 A * 11/1988 Hillmann ..... 439/212
4,792,195 A * 12/1988 Adriaansen et al. ..... 312/245
4,807,764 A * 2/1989 Bellin ..... 211/94.01
4,862,764 A * 9/1989 Gehring ..... 74/606 R
4,974,523 A * 12/1990 Giarratana ..... 108/42
4,987,715 A * 1/1991 Dunn ..... 52/506.08
5,011,239 A * 4/1991 Guerin ..... 312/248
5,039,902 A 8/1991 Schwarz
5,074,419 A 12/1991 Smith
5,097,769 A * 3/1992 Raschbichler et al. ..... 104/124
5,100,008 A 3/1992 O'Herron
5,129,597 A * 7/1992 Manthey et al. ..... 244/118.5
5,131,620 A * 7/1992 Boundy ..... 248/674
5,199,843 A * 4/1993 Sferra ..... 414/592
5,242,219 A 9/1993 Tomaka
5,267,715 A * 12/1993 Owen ..... 248/235
5,400,717 A * 3/1995 Hoehn ..... 104/89
5,484,125 A * 1/1996 Anoszko ..... 248/201
5,595,427 A * 1/1997 Peters et al. ..... 312/140.4
5,649,751 A 7/1997 Longhurst
5,678,654 A * 10/1997 Uzawa ..... 182/150
5,713,157 A * 2/1998 van Leeuwen et al. ..... 52/39
5,725,293 A 3/1998 Wilkening et al.
5,743,438 A * 4/1998 Sokolnicki ..... 222/181.1
5,749,479 A * 5/1998 Belokin et al. ..... 211/113
5,809,905 A * 9/1998 John et al. ..... 108/56.1
5,845,979 A 12/1998 Longhurst et al.
5,893,250 A * 4/1999 Benvenuto et al. ..... 52/506.08
5,938,149 A * 8/1999 Terwesten ..... 244/118.5
D416,152 S * 11/1999 Payne et al. ..... D6/513
6,039,191 A * 3/2000 Purnell ..... 211/118
6,109,461 A 8/2000 Kluge et al.
6,145,678 A * 11/2000 Morrison ..... 211/113
6,161,709 A * 12/2000 Kluge et al. ..... 211/117
6,179,136 B1 1/2001 Kluge et al.
6,286,691 B1 9/2001 Oberhaus et al.
6,311,626 B1 * 11/2001 Roberts ..... 108/42
6,318,671 B1 * 11/2001 Schumacher et al. ..... 244/118.5
6,409,031 B1 * 6/2002 Wynne ..... 211/119
D459,926 S 7/2002 Mikich et al.
6,435,105 B1 * 8/2002 Mikich et al. ..... 108/42
6,439,405 B1 8/2002 Hanneken
6,483,025 B1 * 11/2002 Samsi et al. ..... 174/480
D470,353 S * 2/2003 Mikich et al. ..... D6/513
6,550,878 B2 * 4/2003 Nott et al. ..... 312/248
D485,107 S * 1/2004 Sung ..... D6/570
6,681,941 B1 * 1/2004 Johnson ..... 211/86.01
6,715,427 B2 * 4/2004 Mikich et al. ..... 108/42
6,725,608 B1 * 4/2004 Kraus ..... 52/36.4
6,935,600 B1 * 8/2005 Barrepski ..... 248/317
D516,348 S * 3/2006 Satterthwaite ..... D6/514
7,228,669 B1 * 6/2007 Yaraschefski ..... 52/506.06
7,357,262 B2 * 4/2008 Fratilla ..... 211/117
7,389,614 B2 * 6/2008 Sullivan ..... 52/202
7,445,188 B2 * 11/2008 Lamparter ..... 248/326
2002/0023888 A1 * 2/2002 Wynne et al. ..... 211/119
2002/0043189 A1 * 4/2002 Mikich et al. ..... 108/149
2003/0024196 A1 * 2/2003 Huang ..... 52/506.06
2004/0182291 A1 * 9/2004 Mikich et al. ..... 108/149
2005/0115861 A1 6/2005 Copeland
2005/0188903 A1 * 9/2005 Ryberg ..... 108/149
2006/0070967 A1 * 4/2006 Schaubeck et al. ..... 211/187
2007/0062896 A1 * 3/2007 Richardson et al. ..... 211/117
2007/0145222 A1 * 6/2007 Rausch ..... 248/317
2008/0036341 A1 * 2/2008 Nilsen et al. ..... 312/246
2008/0230499 A1 * 9/2008 Jasniy ..... 211/119

FOREIGN PATENT DOCUMENTS

JP 8209923 8/1996
JP 2001027040 1/2001
JP 2004313247 11/2004

* cited by examiner 10
22
12
22
11
22
32

12
22
32
22
11
24
28
24
28
24
24
28
24
10
22
22
28
24
24
22
24
28
24
22
13
22
22
12
11
34
22
15
34
10

22
32
22
10

SHELF SYSTEM

This application claims the benefit of U.S. Provisional Application Ser. No. 60/782,553 filed on Mar. 15, 2006.

TECHNICAL FIELD

The invention relates generally to an improved shelf system for attachment to the bottom of a single floor or ceiling beam for storing items and the like. More specifically, the invention relates to an improved shelf system that comprises one or more reinforced sections that are attached to the bottom of a single floor or ceiling beam and that are capable of being attached or connected at their ends so as to form a continuous shelf system that spans the entire length of the beam and maximizes the amount of available storage space for the user.

BACKGROUND OF THE INVENTION

In the past, others have developed overhead storage devices in an effort to utilize wasted or unused overhead space in a basement, garage, or the like. The prior art overhead storage devices commonly require that the device be secured to at least two overhead beams. Many of the prior art devices rely heavily upon equal or accurate spacing for their installation because they are affixed to more than one beam and may require additional installation hardware, which is both costly and time consuming and therefore undesirable. The overhead storage devices of the prior art tend to be cumbersome to install and/or operate and may require more than one installer or even a skilled installer.

Moreover, these prior art devices make searching, storing and retrieving an item difficult inasmuch as the individual may not be able to view the article from where they are standing beneath the device and may require multiple trips up and down a step ladder or similar device just to locate the stored item.

Similarly, other prior art devices that require the user to store an item inside a box or container also make it difficult for the party storing the item to locate the stored item without moving the box or container, or items contained therein, to access the item the user is looking for. Further, items stored in closed boxes or containers without any ventilation are susceptible to stale odors and/or mildew over time.

Other prior art devices are relatively weak and tend to warp or deflect, and even fail, over time due to the weight of the stored items, which can result in injury to a user or passerby or damage to the stored items.

There is a need within the art for a shelf system that allows for overhead storage and requires the device be secured to only one overhead beam, while allowing the user to easily access items stored using the shelving system.

SUMMARY OF THE INVENTION

The present invention provides for an improved shelf system that allows for overhead storage. The improved shelf system provides for inwardly sloping shelf sections that may be secured to a single beam. While a single shelf section attached to a single beam can be utilized, the invention also provides embodiments wherein numerous single shelf sections of the improved shelf system may be installed to individual beams, and connected together to form one continuous shelf system.

The installation of the shelf system of this invention is such that a single installer can easily install the system with common household tools. No specialty tools or training is necessary in order to install the system. Items can be stored on the shelf system and easily viewed from a location below the shelf system.

Accordingly, it is an objective of the present invention to provide the art with a new storage system that eliminates the disadvantages associated with prior art overhead storage devices. A further objective of the present invention is to provide a shelf system that can be easily installed and modified by the user to increase or decrease the amount of available storage space available depending upon the user's storage needs.

Yet another objective of the present invention is to provide a durable and reinforced shelf system capable of withstanding heavy loads for prolonged periods of time with minimal or no deflection.

A further objective of the present invention is to allow the user to locate the stored item from the floor by simply walking parallel to the beam until the desired item is located, then using a short ladder or step stool, if necessary, to retrieve the stored item from the shelf. An additional objective of the present invention is to provide a shelf system capable of preventing stored items from rolling or slipping off the shelf and causing injury or damage.

The present invention solves the above described problems and achieves new results by providing an improved shelf system that comprises one or more reinforced and inwardly sloping sections that are attached to the bottom of a single floor or ceiling beam and that are capable of being attached or connected at the ends so as to form a continuous shelf system that can span the entire length of the beam and maximize the amount of available storage space.

These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF THE DRAWINGS

The invention may take physical form in certain parts and arrangements of parts, numerous embodiments of which will be described in detail in the specification and illustrated in the accompanying drawings which form a part hereof, and wherein.

DETAILED DESCRIPTION OF THE DRAWINGS

Figure 1:
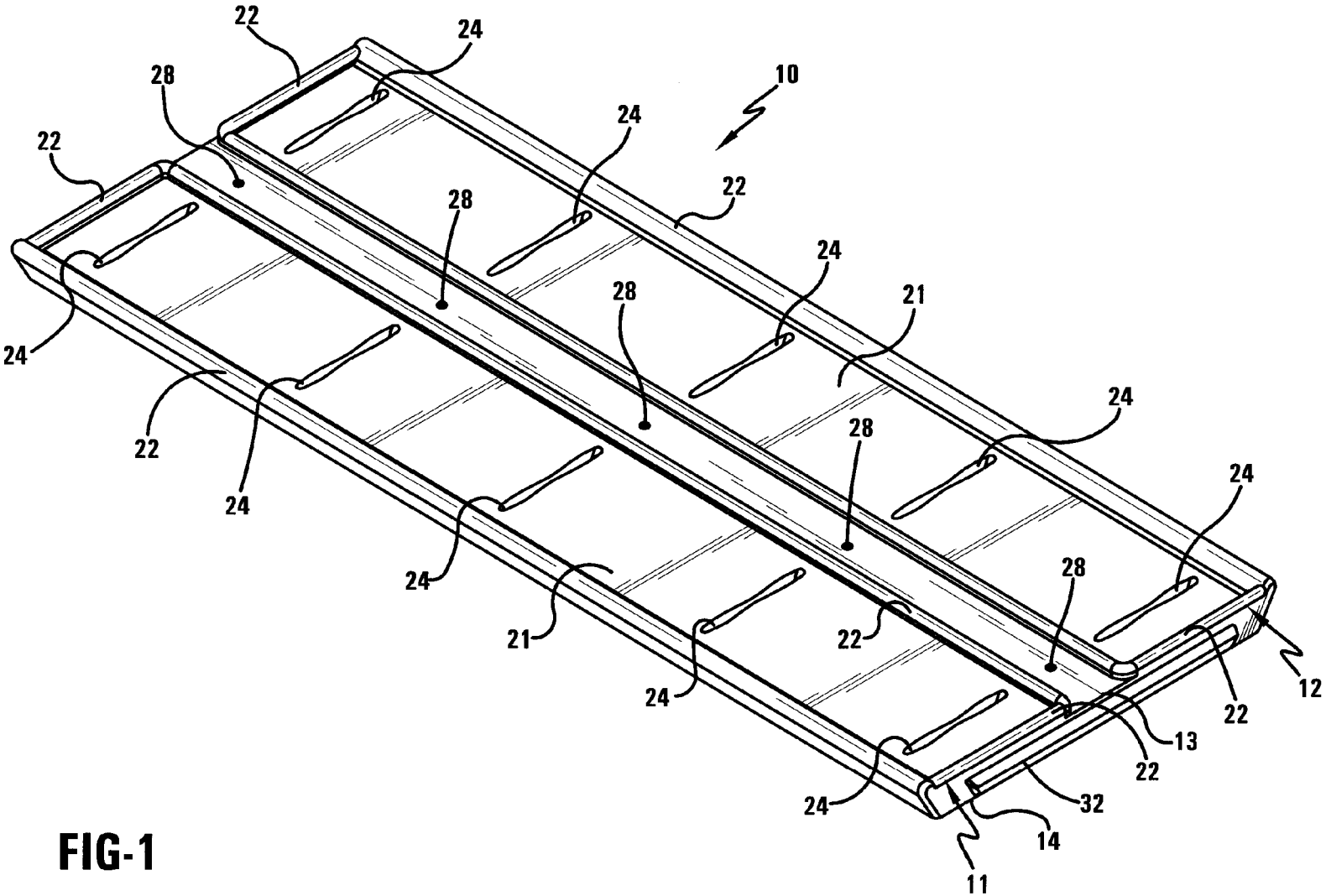
FIG. 1 is a perspective view of one section of the shelf system of an embodiment of the invention.

Referring now to the drawings wherein the showings are for purposes of illustrating numerous embodiments of the invention only and not for purposes of limiting the same, the figures illustrate the novel idea of an improved shelf system for overhead storage.

Described within this application is an improved shelf system that allows for overhead storage. The improved shelf system provides for inwardly sloping shelf sections that may be secured to a single beam. Non-limiting examples of the beam to which the shelf section attaches include a joist or rafter. While a single shelf section attached to a single beam can be utilized, the invention also provides embodiments wherein numerous single shelf sections of the improved shelf system may be installed to individual beams, and connected together to form one continuous shelf system.

A typical shelf segment of the improved shelf system of the present invention is indicated generally at 10 in FIGS. 1 through 5. In the preferred embodiment, shelf segment 10 further includes a pair of side panels 11, 12, and a mounting strip 13. In certain embodiments the shelf may also include a front plate 14 and a rear plate 15. Unless otherwise stated, all components of shelf segment 10 are preferably constructed of a heavy duty plastic with flame retardant additives though it is contemplated that other types of materials could also be used, such as wood, steel, polymers, aluminum or other metals, without affecting the overall concept of the present invention. In the preferred embodiment, the shelf segment is manufactured through a blow molding process commonly know in the art though it is contemplated that other manufacturing and/or production techniques could also be used, depending on the type of materials being utilized, without affecting the overall concept of the present invention.

Figures 2, 3, 4, 5:
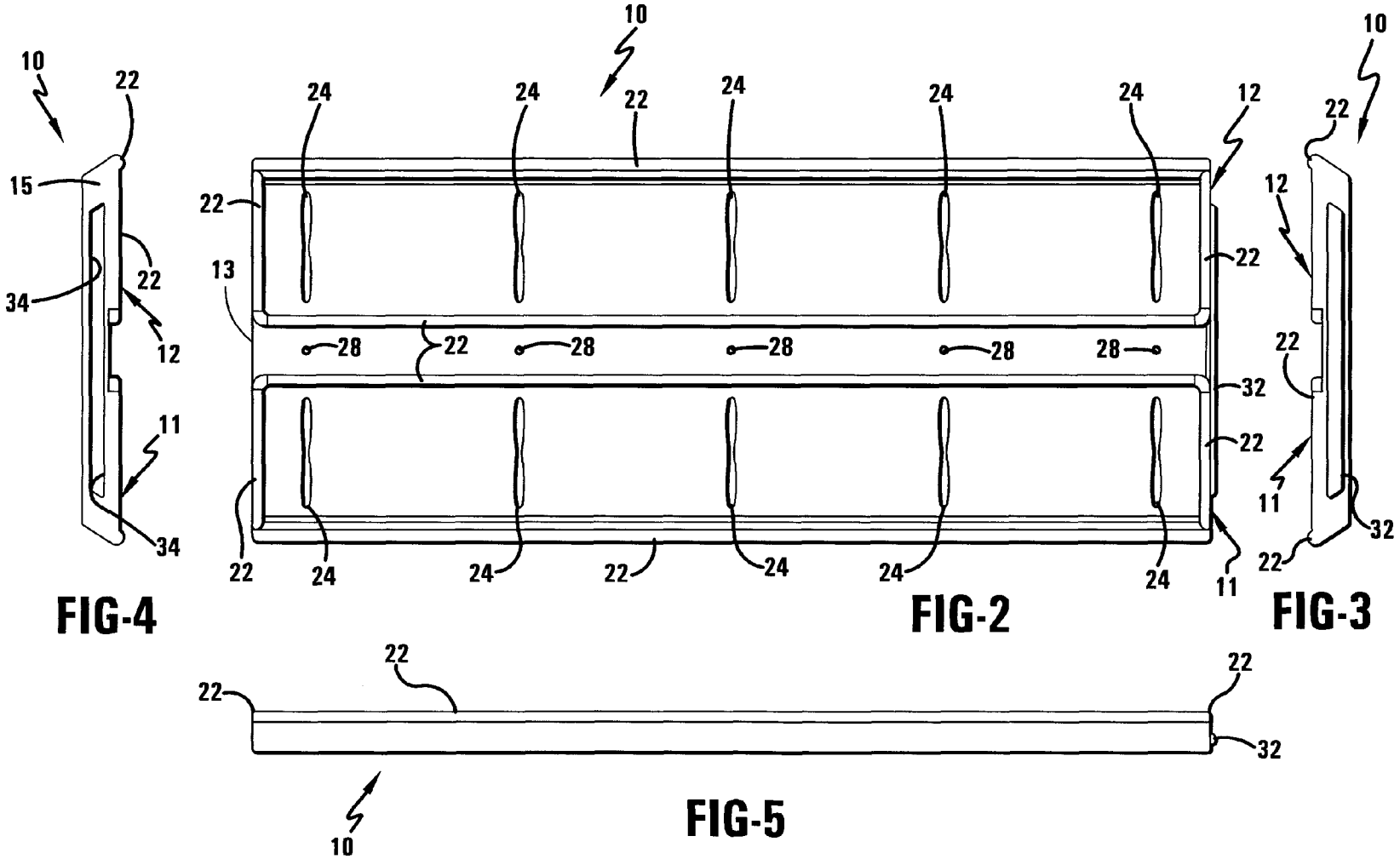
FIG. 2 is a top elevational view of one section of the shelf system of an embodiment of the invention.
FIG. 3 is a side elevational view of one end of one section of the shelf system of an embodiment of the invention.
FIG. 4 is a side elevational view of the opposing end of one section of the shelf system of an embodiment of the invention as that shown in FIG. 3.
FIG. 5 is a side elevational view of one section of the shelf system of an embodiment of the invention.
Figure 7:
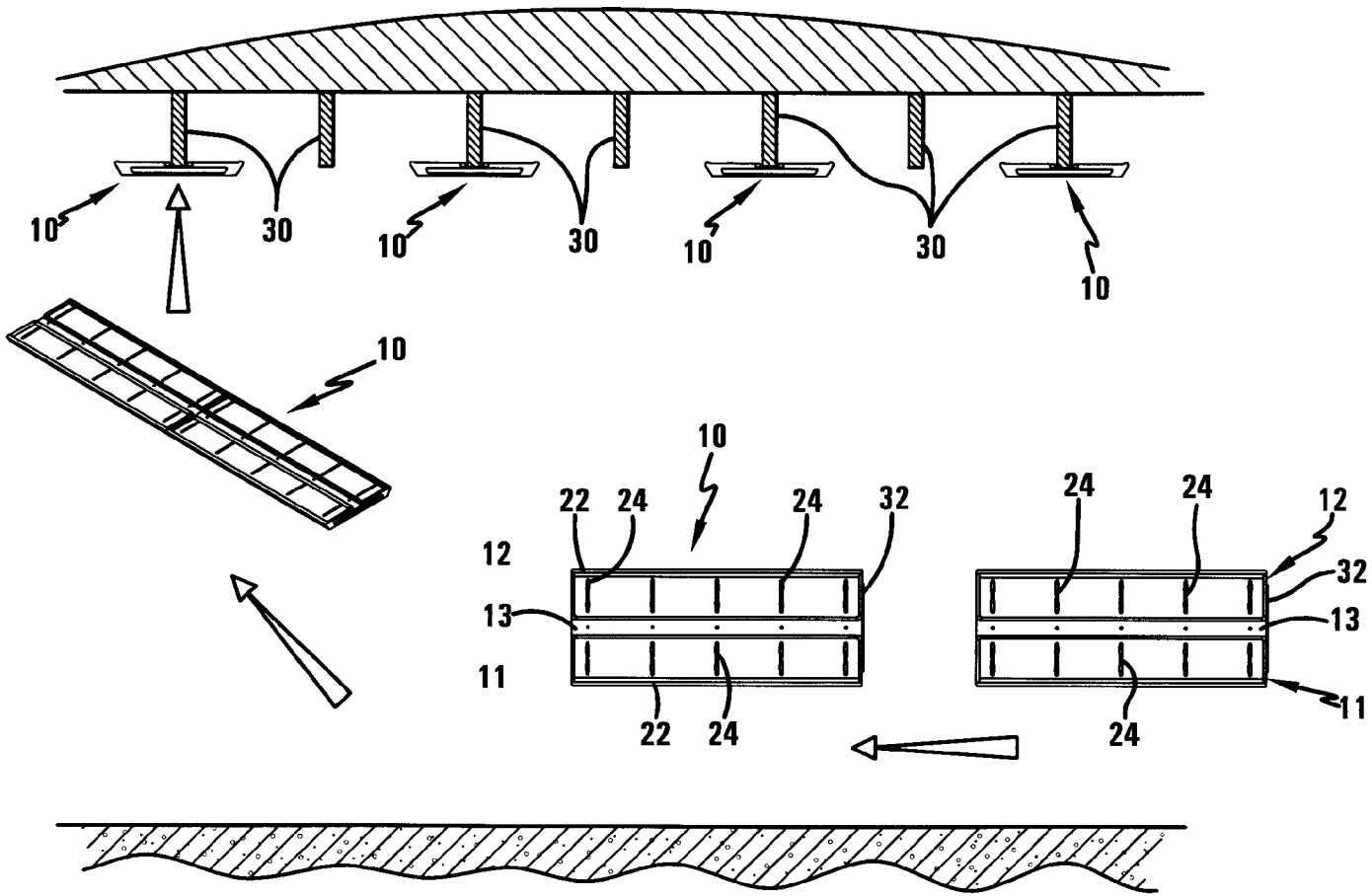
FIG. 7 is a diagram showing the shelf system of an embodiment of the invention as installed on beams.

Side panels 11, 12 are substantially identical so only one will be described below. Side panel 11 further comprises a base 21, an outer rib or lip 22 and a plurality of reinforcement gussets or ribs 24 formed in, and longitudinally spaced apart along base 21 as best illustrated in FIGS. 1 and 2. Outer rib 22 is formed along the perimeter of base 21 and serves multiple functions. More specifically, outer rib 22 adds strength to shelf segment 10, particularly if shelf segment is installed and interconnected with another shelf segment to form the improved shelf system of the present invention as described more fully below. Additionally, because outer rib 22 rises above the surface of base 21, outer rib 22 tends to prevent the stored item from rolling or slipping off of shelf segment 10. Further, the segment of outer rib 22 adjacent to mounting strip 13 serves the further purpose of enabling the installer of shelf segment 10 to easily align and properly install shelf segment 10 on a beam 30, as best illustrated in FIG. 7 and described more fully below.

Figure 9:
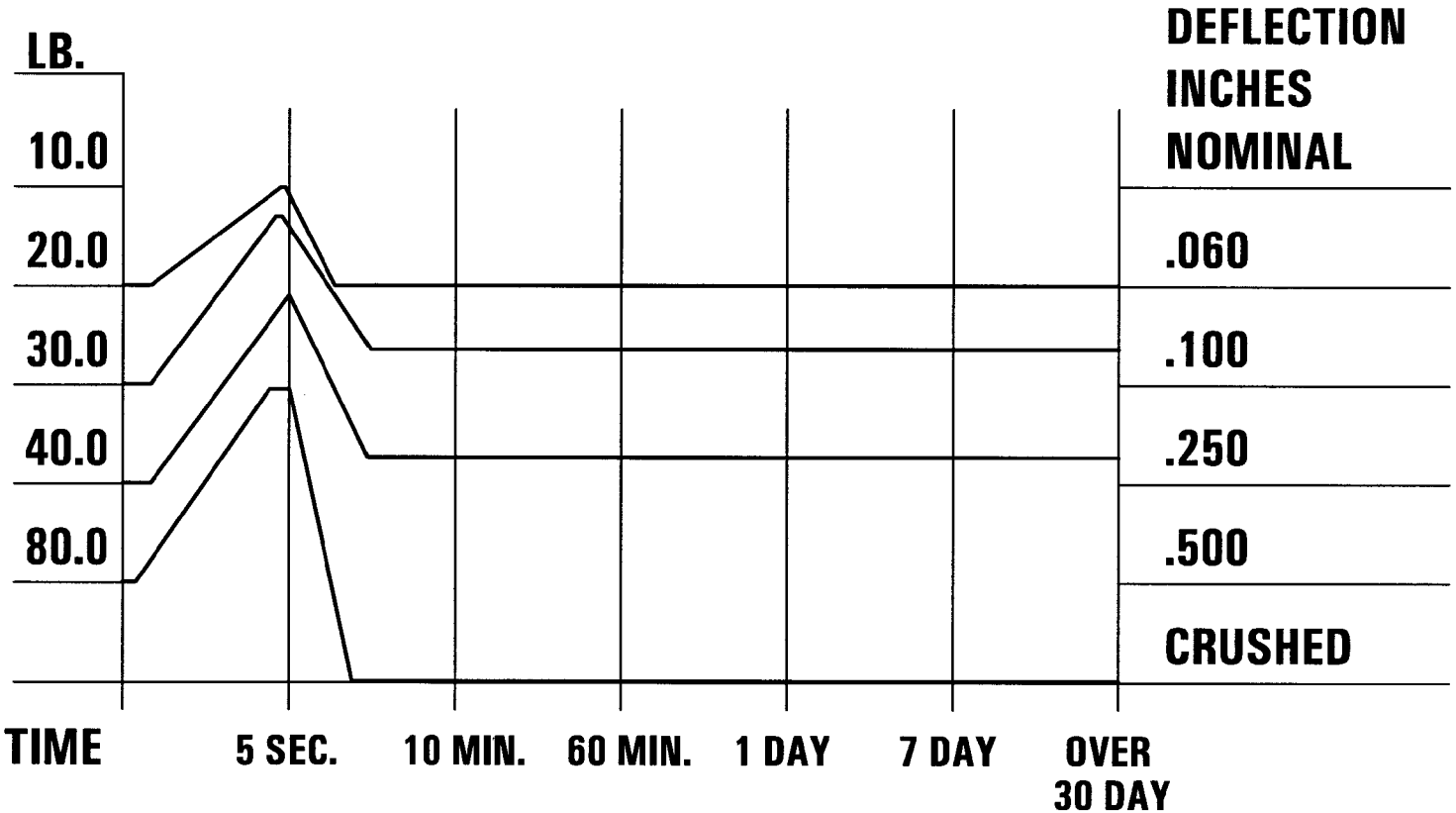
FIG. 9 is a graph indicating the deflection of the shelf system of an embodiment of the invention under varying loads for varying periods of time.

As indicated above, reinforcement ribs 24 are spaced apart longitudinally along shelf base 21 and also add strength to shelf segment 10, thereby reducing or eliminating the deflection and deformation problems associated with prior art overhead storage devices as illustrated in the table contained in FIG. 9. In the preferred embodiment, reinforcement ribs 24 also help keep the top and bottom surfaces of base 21 from collapsing against each other. A cross section of reinforcing rib 24 is shown generally in FIG. 6.

Figure 6:
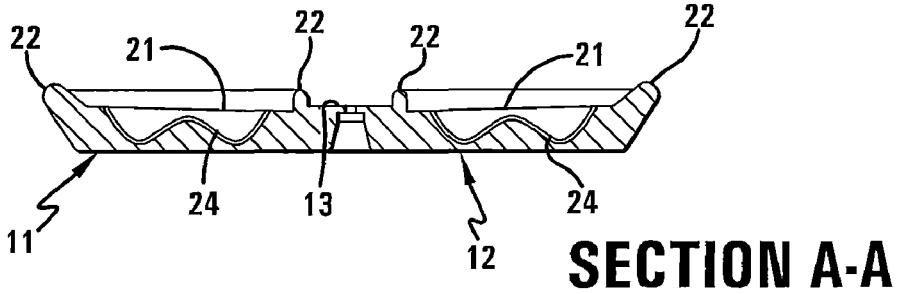
FIG. 6 is a top elevational view of a portion of one section of the shelf system of an embodiment of the invention, cut along plane A-A, with a side elevational view of the same portion of one section of the shelf system along plane A-A.
Figure 6:
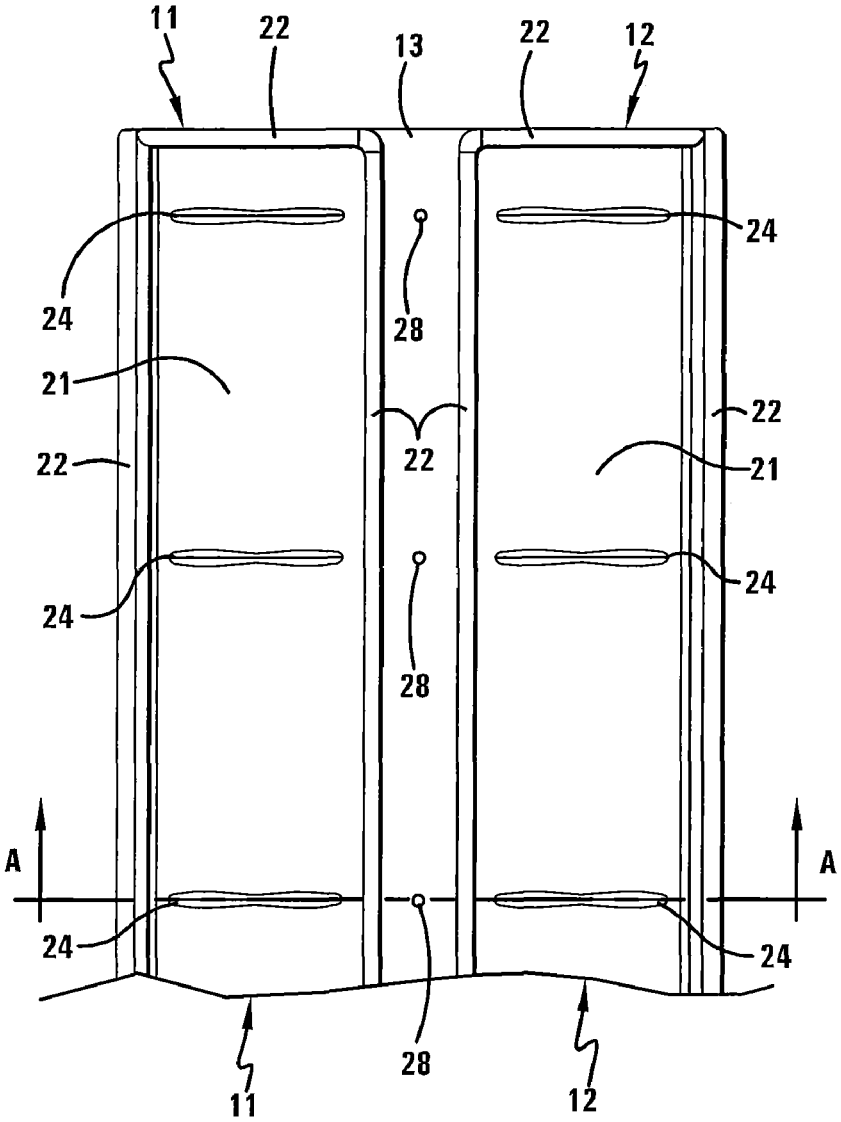
Figure 10A:
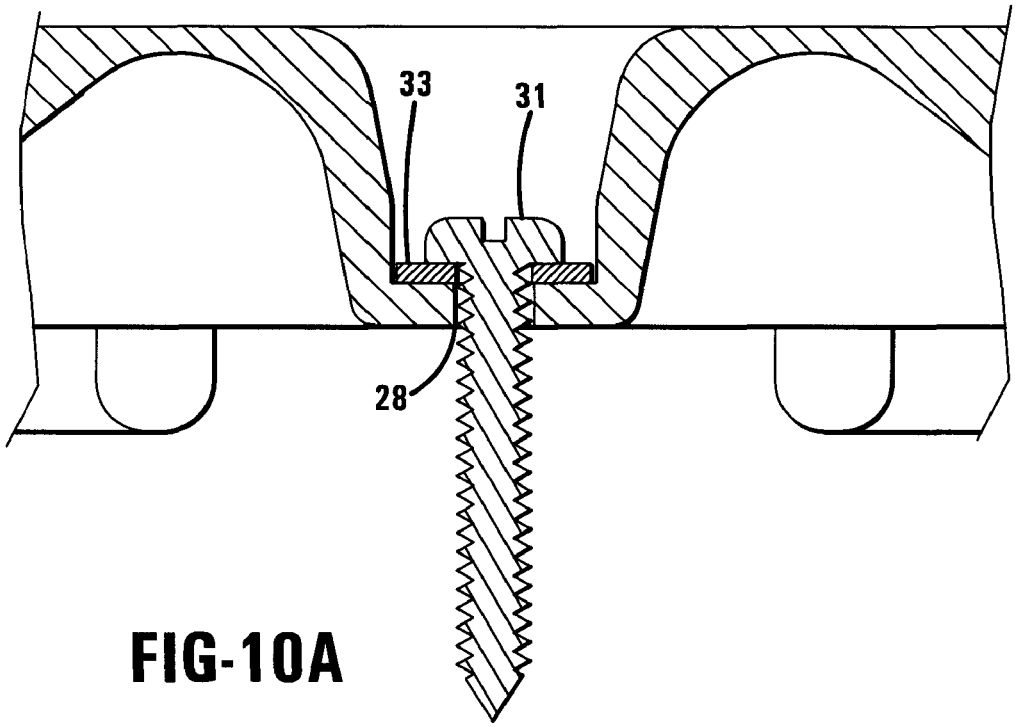
FIG. 10A is a side elevational close-up view of the fastening of a section of the shelf system of an embodiment of this invention with use of a washer.
Figure 10B:
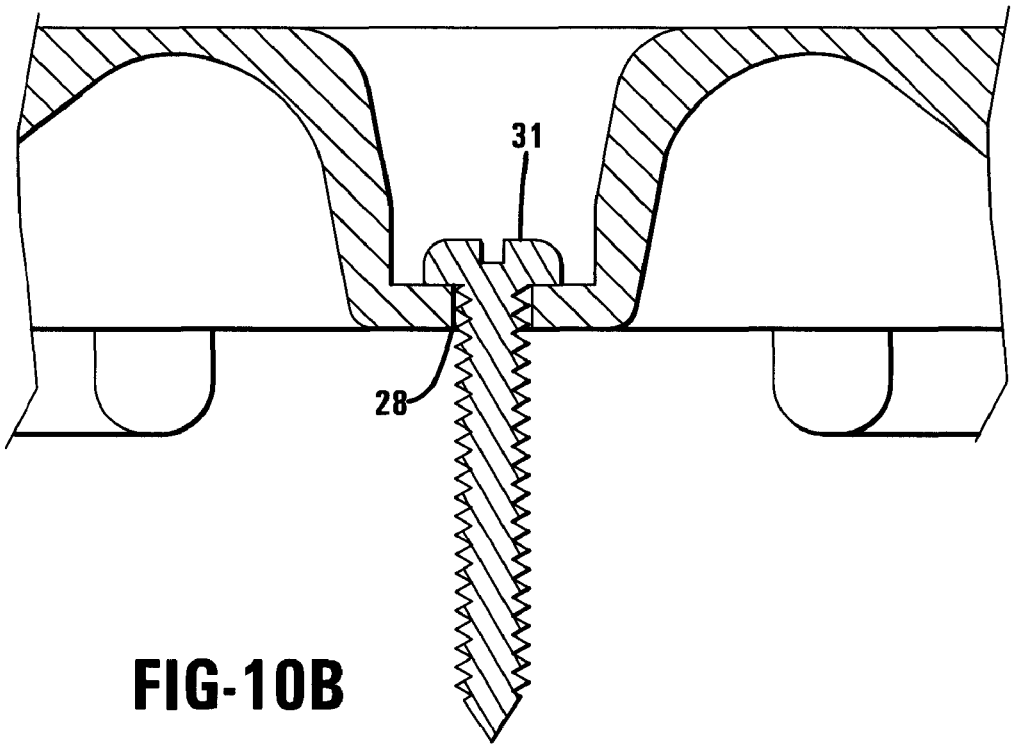
FIG. 10B is a side elevational close-up view of the fastening of a section of the shelf system of an embodiment of this invention without use of a washer.

Each of side panels 11 and 12 are positioned generally longitudinally parallel to one another, such that the side panels run in the same direction and are spaced apart and separated by mounting strip 13, as best shown in FIGS. 1, 2 and 6. The width of mounting strip 13 is preferably sized to accommodate the width of most beams though it is contemplated that the width can be greater or smaller, depending on the application and needs of the user, without affecting the overall concept of the present invention. In certain embodiments, mounting strip 13 further comprises a plurality of continuous openings 28 formed therein for receipt of a fastener (not shown) used to mount shelf segment 10 to beam 30 as best shown in FIG. 7. More specifically, an installer (not shown) desiring to mount shelf segment 10 on beam 30 can use those outer ribs 22 of side panels 11, 12 adjacent to mounting strip 13 to align shelf segment 10 on beam 30 such that beam 30 fits between said outer ribs 22 nearest mounting strip 13. The installer can then removably attach shelf segment 10 to beam 30 by inserting fasteners 31, such as screws or nails, through openings 28 and into beam 30, thereby securely, but removably, attaching shelf segment 10 to beam 30. Alternatively, it is also contemplated that shelf segment 10 could be affixed to a beam through a drywalled or plastered ceiling (not shown) with the use of a beam extension (not shown), without affecting the overall concept of the present invention. Moreover, in the preferred embodiment of the present invention, each of fasteners 31 further comprise a built-in washer 33, as illustrated in FIG. 10A and FIG. 10B, to add further strength to shelf segment 10 by more securely attaching shelf segment 10 to beam 30. Providing a built-in washer 33 with fastener 31 also reduces the likelihood that a consumer or installer will misplace the washer, as is commonly the case with stand alone washers. Notwithstanding, it is contemplated that a stand alone washer (not shown) of a type common in the art, or a fastener 31 with an oversized head portion but no washer (not shown), could also be used without affecting the overall concept of the present invention.

It is also foreseen that specialized shelf sections are envisioned to fit in specialized areas. By non-limiting example, certain embodiments of this invention include a shelf section wherein the two side panels are of different widths or configurations to allow a shelf section to be secured to a beam that abuts a wall or other vertical member, wherein a shelf section with two equal width side panels will not fit. A shelf section with only one side panel attached to the mounting strip is also foreseen, allowing the shelf to be mounted to a beam that abuts a wall.

Figure 8:
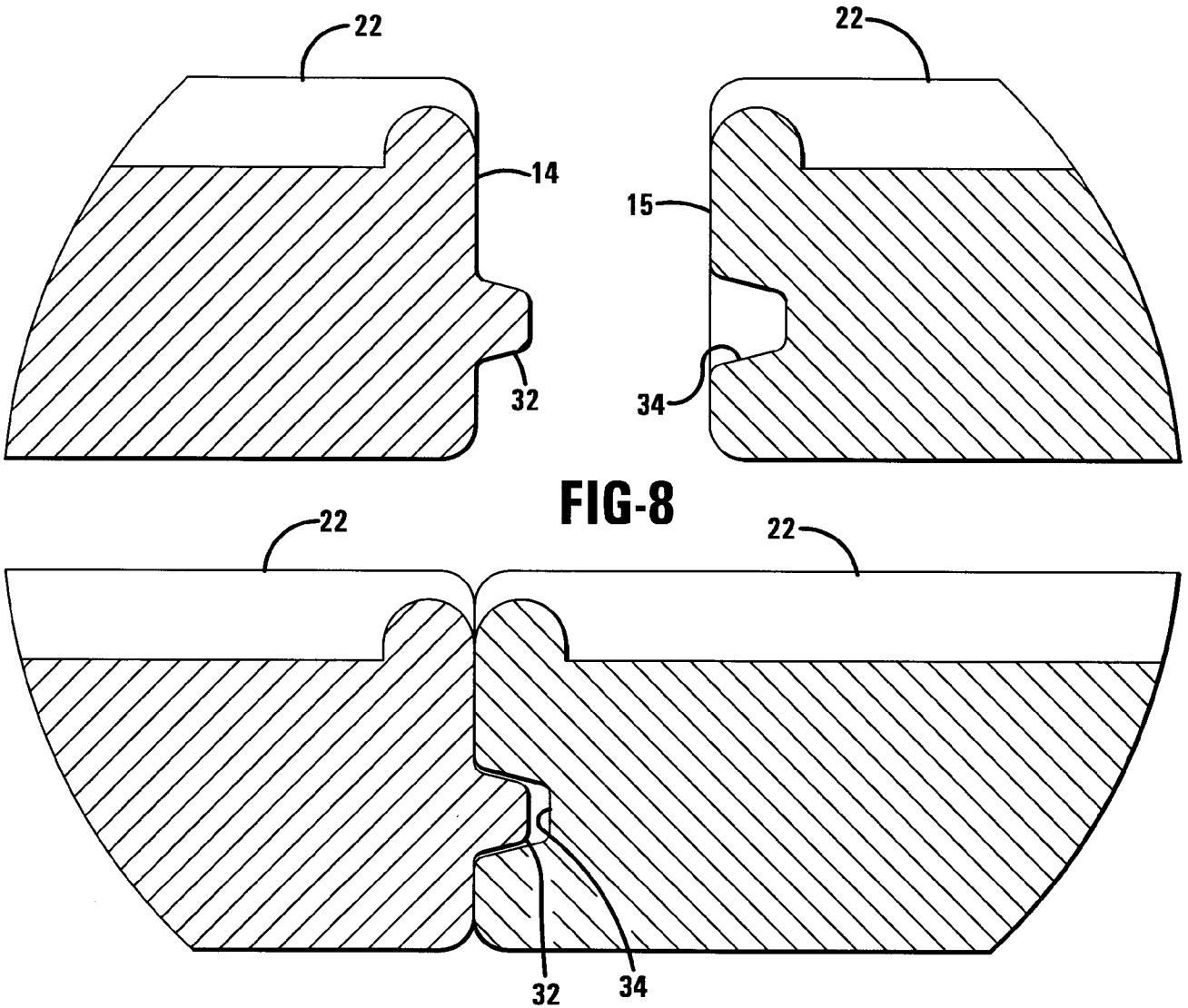
FIG. 8 is a side elevational view of two sections of the shelf system of an embodiment of the invention in connected and unconnected configurations.

As another important feature of the present invention, protruding member 32 such as a tongue is formed in front plate 14 and a corresponding groove 34 is formed in rear plate 15, as best illustrated in FIG. 8. Protruding member 32 is designed such to be engageable with groove 34, enabling a user or installer to interconnect multiple shelf segments 10 to form a continuous shelf system along beam 30. More specifically, before or after installation of shelf segment 10 along beam 30 as described above, an installer can abut a second shelf segment 10 against the first shelf segment such that tongue 32 of first shelf segment 10 fits into groove 34 of second shelf segment, as shown in FIG. 8. Additional shelf segments can be similarly attached to one another and beam 30, as appropriate, to accommodate the installer or user's storage needs.

As yet another important feature of the present invention, items stored on the improved shelf system of the present invention are easily viewed by the user. More specifically, shelf segment 10 extends from each side of supporting beam 30 enough distance, but short of spanning the entire distance between beams, to allow the stored items to be visible to the user and to allow the user to access base 21 for storage from any point along shelf segment 10. Therefore, the user is not required to remember where he or she stored the item along shelf segment 10 and ladder access is not necessary until the user has visually located the item for retrieval.

It is also contemplated within certain embodiments of the invention, that base 21 of each of side panels 11, 12 can be inclined slightly in the general direction of mounting strip 13 to ensure that stored items do not slide or roll off of side panels 11, 12 and fall to the ground and injure a user or passerby or cause damage to the stored item. In further embodiments the entirety of side panels 11, 12 can be inclined slightly towards mounting strip 13 to achieve the same purpose. More specifically, stored items can be placed on the slightly inclined base 21 and leaned against the sides of floor beam 30 when mounting strip 13 is secured to beam 30. The slight incline of base 21 towards beam 30, along with outer rib 22, helps prevent items from falling off shelf segment 10 and causing damage or injury. Moreover, shelf segment 10 permits items to be conveniently stored in the open air without the need for additional boxes and/or storage bins thereby reducing or eliminating the foul odors and condensation and mildew associated with items stored in boxes and bins for prolonged periods of time with little or no ventilation.

Additionally, minor variances in spacing between beams 30, as is typical in older homes and buildings due to minor warping, does not affect the usefulness of the present invention because the shelf system is attached to only one beam.

Accordingly, the improved shelf system of the present invention is simplified, and provides an effective, safe, inexpensive, and efficient system which achieves all the enumerated objectives, eliminates costly and unnecessary features encountered with prior art overhead storage devices, and solves problems and obtains new results in the art.

Described herein is an overhead storage shelf which includes a pair of side panels, with each side panel including a base, an outer rib connected to the base, and at least one reinforcement rib connected to the base. The storage shelf further includes a mounting strip for connecting the pair of side panels, wherein the mounting strip facilitates the securing the shelf to a single beam. Certain embodiments of the invention include a front plate and a rear plate. In other embodiments of the invention either the front or rear plate includes a protruding member and the opposing or other plate contains a groove wherein the protruding member of the front or rear plate of one shelf section can be engaged in the groove of the front or rear plate of a second shelf section, allowing the shelf sections to removably interconnect.

In certain embodiments the shelf may have a plurality of reinforcement ribs longitudinally spaced along the base. In certain embodiments, the side panels may be inwardly inclined towards the mounting strip and in further embodiments only the base of the side panels may be inwardly inclined towards the mounting strip. The mounting strip may, but does not necessarily contain a plurality of openings formed to receive a fastener wherein the fastener secures the shelf to the beam. In certain embodiments the shelf may be constructed off a heavy duty plastic with flame retardant additives.

Also described herein is a shelf system that includes at least two shelf sections. Each shelf section includes a pair of side panels, with each side panel including a base, an outer rib connected to the base, at least one reinforcement rib connected to the base. Each shelf section further includes a mounting strip for connecting the pair of side panels, wherein the mounting strip facilitates the securing the shelf section to a single beam. A front plate and a rear plate are included, with either the front or rear plate including a protruding member and the opposite plate containing a groove wherein the protruding member of the front or rear plate of one shelf section can be engaged in the groove of the front or rear plate of a second shelf section, allowing the shelf sections to be removably interconnected. The sections can be attached to a single beam, positioned such that the shelf sections are interconnected along a single beam.

In the foregoing description, certain terms have been used for brevity, clearness, illustration and understanding; but no unnecessary limitations are to be implied therefrom beyond the requirements of the prior art, because such terms are used for descriptive purposes and are intended to be broadly construed. Moreover, this invention has been described in detail with reference to specific embodiments thereof, including the respective best modes for carrying out each embodiment. It shall be understood that these illustrations are by way of example and not by way of limitation.

What is claimed is:

1. A storage shelf which comprises:

(a) a pair of side panels, wherein each side panel of said pair of side panels includes a front plate, a rear plate, a base with an outer rib and a plurality of reinforcement ribs;

(b) a mounting strip connecting said pair of side panels, wherein said mounting strip facilitates the securing of said storage shelf to a single beam, and wherein the mounting strip and the outer rib of each side panel align the storage shelf on the beam, such that the beam fits between opposing portions of the outer ribs of the pair of side panels, said opposing portions of the outer ribs being located on opposite sides of said mounting strip; and (c) wherein one of said front plate or said rear plate contains a protruding member and said other of said front plate or said rear plate contains a groove, said protruding member and said groove being configured to be engageable with a corresponding groove or protruding member of another storage shelf for allowing the interconnecting of multiple storage shelves;

(d) wherein said plurality of reinforcement ribs are spaced along and transversely extend with respect to a longitudinal length of each corresponding said base.

2. The storage shelf of claim 1 wherein a portion of at least one side panel of said pair of side panels is downwardly inclined towards said mounting strip.

3. The storage shelf of claim 1 wherein a portion of said base of at least one side panel of said pair of side panels is downwardly inclined towards said mounting strip.

4. The storage shelf of claim 1 wherein said mounting strip contains at least one opening formed therein for receipt of a fastener, wherein said fastener secures said storage shelf to said beam.

5. The storage shelf of claim 1 wherein said storage shelf is constructed of plastic.

6. The storage shelf of claim 1 wherein said storage shelf is constructed of metal.

7. The storage shelf of claim 1 wherein said storage shelf is constructed of wood.

8. The storage shelf of claim 1 wherein said storage shelf is constructed of a material with at least one flame retardant additive.

9. A shelf system which comprises:

(a) at least two shelf sections, wherein each shelf section comprises:

(i) a pair of side panels, wherein each side panel of said pair of side panels includes a front plate, a rear plate, and a base with an outer rib and a plurality of reinforcement ribs; and (ii) a mounting strip connecting said pair of side panels, wherein said mounting strip facilitates the securing of said shelf section to a single beam, and wherein the mounting strip and the outer rib of each side panel aligns each shelf section on the beam, such that the beam fits between opposing portions of the outer ribs of the pair of side panels, said opposing portions of the outer ribs being located on opposite sides of said mounting strip;

(b) wherein one of said front plate or said rear plate contains a protruding member and said other of said front plate or said rear plate contains a groove; and (c) wherein said protruding member of one section of said at least two shelf sections is engageable within said groove of another section of said at least two shelf sections such that said at least two shelf sections are interconnected;

(d) wherein said plurality of reinforcement ribs are spaced along and transversely extend with respect to a longitudinal length of each corresponding said base.

10. The shelf system of claim 9 wherein said at least two shelf sections are attached to a single beam, positioned such that the at least two shelf sections are interconnected along the single beam.

11. The shelf system of claim 9 wherein a portion of at least one side panel of said pair of side panels is downwardly inclined towards said mounting strip.

12. The shelf system of claim 9 wherein a portion of said base of at least one side panel of said pair of side panels is downwardly inclined towards said mounting strip.

13. The shelf system of claim 9 wherein said mounting strip of at least one of said at least two shelf sections contains at least one opening formed therein for receipt of a fastener, wherein said fastener secures said shelf system to said beam.

14. The shelf system of claim 9 wherein at least one shelf section of said at least two shelf sections is constructed of plastic.

15. The shelf system of claim 9 wherein at least one shelf section of said at least two shelf sections is constructed of metal.

16. The shelf system of claim 9 wherein at least one shelf section of said at least two shelf sections is constructed of a material with at least one flame retardant additive.

* * * * *